United States Patent [19]

McCaughna

[11] 4,167,724

[45] Sep. 11, 1979

[54] THERMAL SWITCHES

[76] Inventor: James R. McCaughna, 5521 E. Exeter Blvd., Phoenix, Ariz. 85018

[21] Appl. No.: 851,196

[22] Filed: Nov. 14, 1977

[51] Int. Cl.[2] ..... H01H 37/76

[52] U.S. Cl. ..... 337/408; 337/407

[58] Field of Search ..... 337/401, 402, 403, 404, 337/407, 408, 409, 416, 405; 116/114.5

[56] References Cited

U.S. PATENT DOCUMENTS 3,944,960 3/1976 Audette et al. ..... 337/408

*Primary Examiner*—Harold Broome

*Attorney, Agent, or Firm*—Cushman, Darby & Cushman

[57] ABSTRACT

A thermal switch comprising a conductive casing defining a switch axis, a terminal connected to the casing and a terminal entering the casing in insulated relationship thereto, and within the casing a normally solid fusible pellet and a resilient contact means normally in electrically conductive relationship with the insulated terminal and which is compressed in the axial direction against said normally solid fusible pellet, whereby said contact means is normally expanded in the radially outwards direction to contact the casing and thereby establish an electrical connection between the casing and the insulated terminal, the pellet having a preselected temperature of disintegration at which it will collapse to release the axial pressure on the resilient contact means and thereby permit its radial contraction.

8 Claims, 7 Drawing Figures

THERMAL SWITCHES

FIELD OF THE INVENTION

This invention relates to a thermal switch, which as used herein means an electrical device having a pair of terminals and a movable conductive part normally biassed into an operative position in which it establishes a conductive path between the terminals and being movable out of such position to break said conductive path upon collapse of a normally solid fusible pellet means.

Thermal switches are used for a wide variety of purposes, primarily to give protection against faults or hazards giving rise to an undue rise in the environmental temperature, but in addition to give overcurrent protection, at least to a limited extent, at the same time.

PRIOR ART

One known construction of thermal switch comprises a conductive casing having a first terminal connected to one closed end of the casing and a second terminal projecting through an insulating mass closing the other end of the casing. Within the casing the insulated terminal is in electrical contact with a thin resilient disc which slidably contacts the interior wall of the casing. This disc establishes an electrically conductive path from said first terminal to the second terminal. The disc is maintained in its operative position in electrical contact with the insulated terminal by means of a compression spring acting against an abutment formed by a pellet of fusible waxes. A weaker trip spring is operative in the opposite direction between the disc and insulating mass. When due to overheating the fusible pellet collapses, the compression spring is released to allow the weaker trip spring to drive the disc slidably along the interior of the casing into an inoperative position spaced from the insulated terminal. The conductive path between the first and second terminals is thereby broken.

In the known arrangement of thermal switch, the construction of the slidable disc is of critical importance. It can be made by stamping thin conductive foil in a star shape, slightly oversized relative to the casing, so as to be resiliently deformed when the switch is assembled and thereby ensure good electrical contact with the interior wall of the casing. However, while the use of such a thin foil construction is in some ways disadvantageous, the use of a more robust disc, which would assist reliable operation, would entail materially increased manufacturing costs.

OBJECT OF THE INVENTION

It is an object of the present invention to provide a thermal switch having an improved contact means which can be easily and inexpensively manufactured and assembled in the switch to ensure reliable operation.

BRIEF SUMMARY OF THE INVENTION

According to the present invention, there is provided a thermal switch comprising a conductive casing defining a switch axis, a terminal connected to the casing and a terminal entering the casing in insulated relationship thereto, and within the casing a normally solid fusible pellet and a resilient contact means normally in electrically conductive relationship with the insulated terminal and which is compressed in the axial direction against said normally solid fusible pellet, whereby said contact means is normally expanded in the radially outwards direction to contact the casing and thereby establish an electrical connection between the casing and the insulated terminal, the pellet having a preselected temperature of disintegration at which it will collapse to release the axial pressure on the resilient contact means and thereby permit its radial contraction.

In one construction the contact means takes the form of a hollow double diaphragm having opposed dished walls, preferably of elongated elliptical shape. Normally the diaphragm is compressed directly between the fusible pellet and the second abutment fixed to the insulated terminal. When the pellet collapses, the electrical contact between the contact means and the casing is broken. In a second construction, the contact means takes the form of an open-ended box having two side walls which are normally resiliently deformed in the radially outwards direction to contact the casing. The box is compressed between the pellet and the insulated terminal; however, a spring is preferably provided to urge the box axially away from the fixed terminal when the pellet collapses, whereby the normal electrically conductive relationship between the contact means and the insulated terminal is broken. Only a relatively weak spring is necessary to urge the box axially due to the radial contraction of the box which occurs when the axial pressure on the box is released due to collapse of the pellet.

FURTHER FEATURES OF THE INVENTION

Clearly, the fusible waxes of which the pellet is made are chosen in an endeavour to cause operation of the switch at a preselected temperature appropriate to the circumstances of use. However, known mixtures of waxes, as hitherto employed, have two major disadvantages. Firstly, in environments normally subject to substantial temperature changes approaching the preselected temperature of operation of the switch, the wax material is liable to be repeatedly softened. This has a detrimental effect on the behavior of the switch; eventually the switch may be operated prematurely, or worse, the switch may not operate properly when required to do so. Secondly, a thermal switch is sometimes required for use in environments other than air, for example in oil filled heating appliances or the like, wherein the surrounding fluid is a good thermal conductor. It is sometimes found that, due to the undesirable slow melting of the waxes which tends to occur under these conditions, the disc contact fuses to the insulated terminal, permanently short-circuiting the first and second terminals, before the pellet completely collapses.

Preferably, therefore, the pellet means comprises a pellet made of a mixture of fusible was material and ferrite material. The pellet preferably comprises at least 10 parts by volume of ferrite material to 100 parts of fusible wax material.

BRIEF DESCRIPTION OF DRAWINGS

In the accompanying drawings:

FIG. 5*a* shows a contact means for the switch of FIG. 1 in perspective view, while

DESCRIPTION OF EMBODIMENTS

Figure 1:
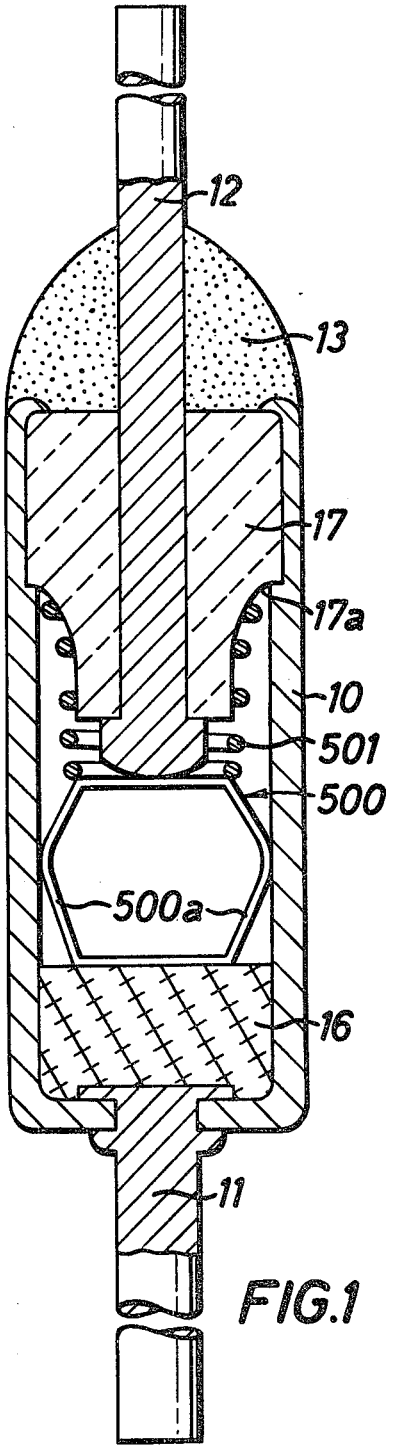
FIG. 1 illustrates one thermal switch construction in its normal condition.
Figure 2:
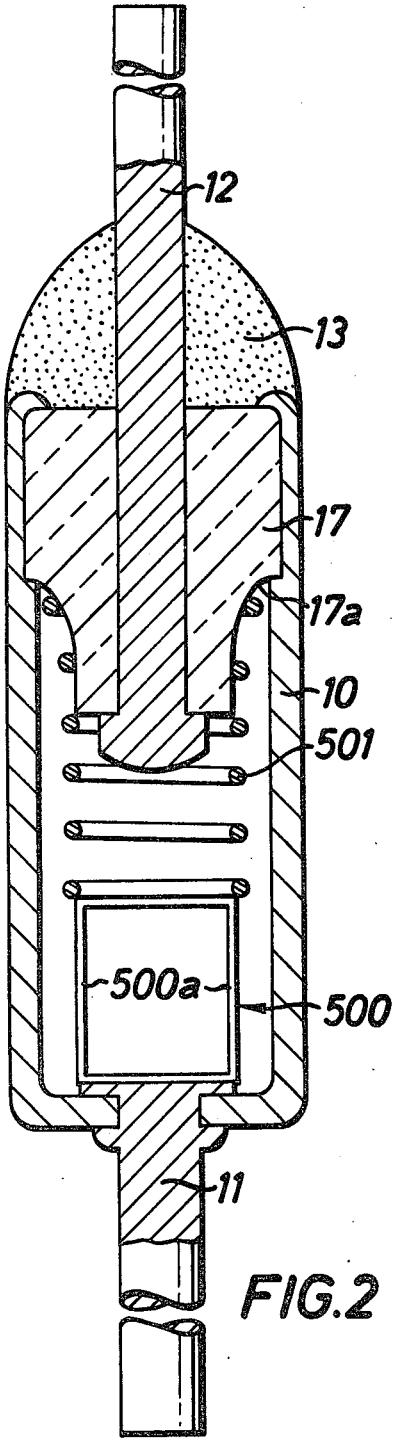
FIG. 2 shows the construction of FIG. 1 in the operated condition.

The construction shown in FIG. 1 comprises a tubular conductive casing 10 electrically connected to a terminal conductor 11 fixed in position to seal one end of the casing. A terminal conductor 12 projects through an insulator 17, which closes the other end of the casing. The insulator 17 is preferably a ceramic bead or alternatively a high-temperature-resistant plastics material which does not outgas readily, such as that known by the Trade Mark Ryton R-4. The periphery of the casing is crimped over the insulator 17 and sealing is completed by an insulating mass 13, for example of an epoxy resin. Within the casing is a contact means in the form of a rectangularly-shaped open-ended conductive tube or box 500 positioned with its axis perpendicular to the axis of the casing 10. This contact box 500 is located and compressed (during assembly of the switch) between a fusible pellet 16 and the head of the insulated terminal 12. The face of the head of the insulated terminal may be either rounded (as shown) or flat. In the normal operative condition of the switch, the contact box 500 serves to complete the circuit connection between the casing 10 and the terminal 12. Thus, due to the compression of the box 500 in the axial direction of the casing, its lateral walls 500*a* are deformed radially outwards of the casing axis to contact the wall of the casing 10. When the pellet 16 collapses on reaching a preselected temperature, the axial pressure on the box 500 is released, allowing it to contract radially out of contact with the casing. The electrical connection between the casing 10 and the terminal 12 is thus broken. Preferably, as shown in the drawing, a weak spring 501 is provided, normally compressed between the box 500 and a tapered shoulder 17*a* formed on the ceramic bead 17. The spring 501 is weak enough not to jeopardise the electrical contact between the contact box 500 and the end of the terminal 12, but is strong enough to displace the box 500 axially away from the terminal 12 when the pellet 16 collapses and the box 500 contracts radially. It is thereby doubly ensured that the electrical connection between the casing 10 and the insulated terminal 12 is broken. The switch is shown in its operated condition in FIG. 2; the pellet 16 has collapsed, and the contact box 500 has contracted radially and has been pushed by the spring 501 out of contact with the terminal 12.

Figure 5A:
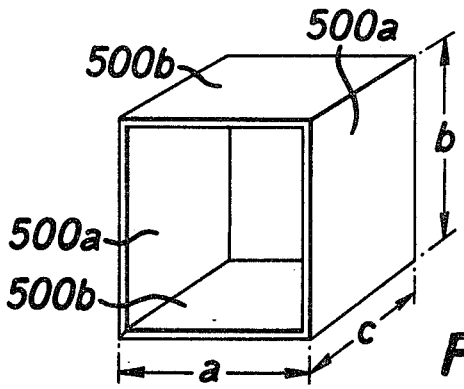
Figure 5B:
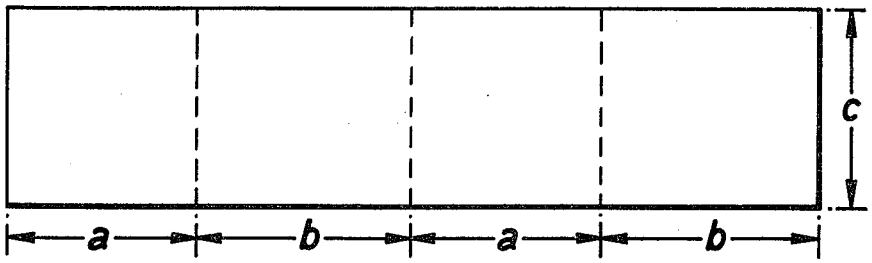
FIG. 5*b* shows a strip for use in producing the contact means of FIG. 5*a*.

The contact box 500 for the switch of FIG. 1 is shown in FIG. 5*a* in its relaxed condition. The top and bottom walls of the box 500 which, in the assembled switch, abut the terminal 12 and the pellet 16, either directly or through load-distributing spacers, are designated 500*b*. The contact tube or box 500 may be easily formed from a metal strip (FIG. 5b) by bending along the dotted lines indicated. After forming by bending, the contact box is heat treated to effect spring tempering.

In the event that the spring 501 is not provided in the above-described construction, the top wall 500*b* of the contact box 500 is preferably fixed to the terminal 12 centrally on the casing axis, whereby to avoid the small risk that, when the pellet 16 collapses, the box is displaced into a tilted position which does not properly break the electrical connection between the casing 10 and the insulated terminal 12.

Figure 3:
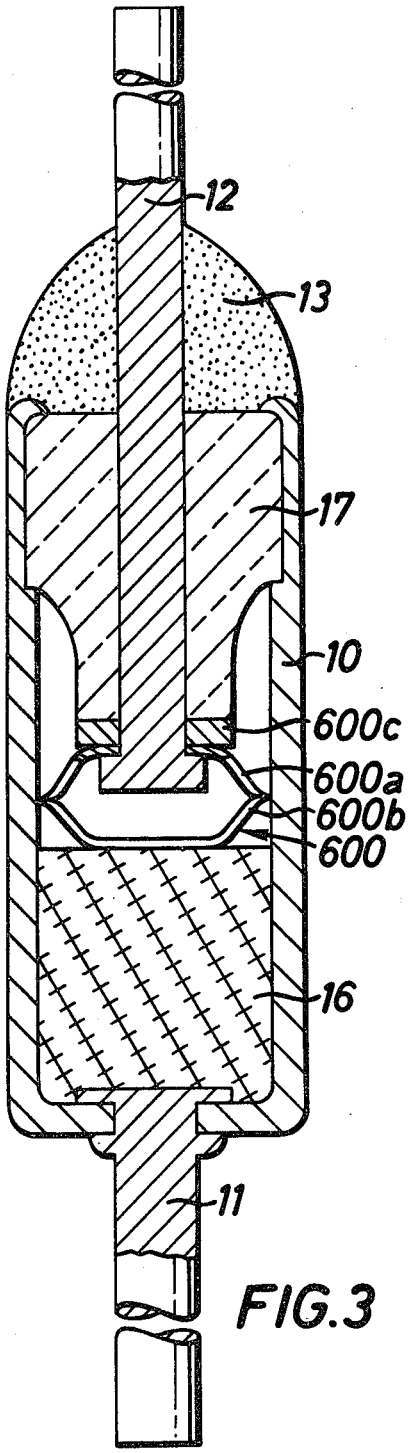
FIG. 3 illustrates a second thermal switch construction, in the normal condition ready for operation.
Figure 4:
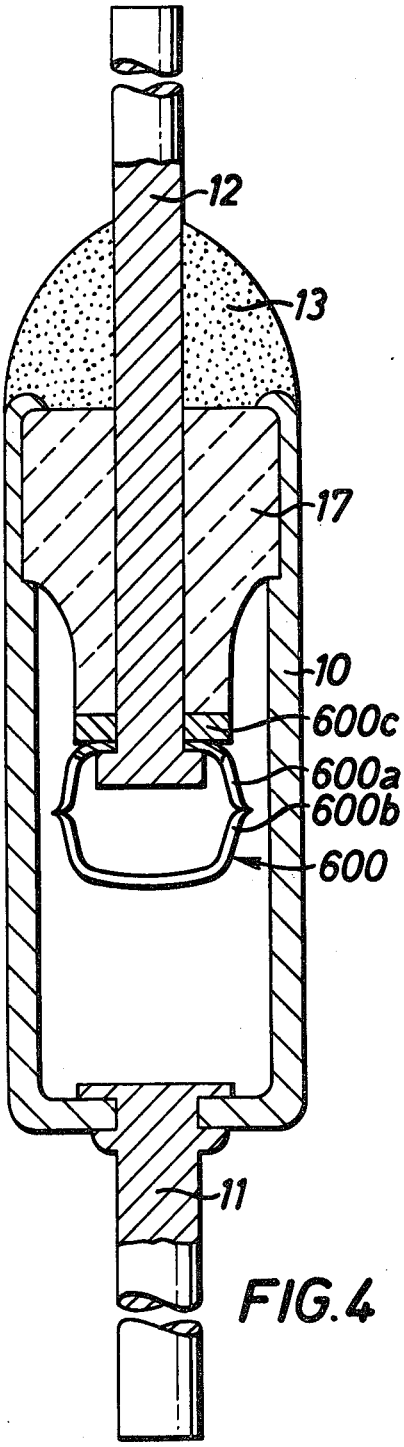
FIG. 4 shows the construction of FIG. 3 in the operated condition.

In the alternative construction shown in FIG. 3, the contact box is replaced by a hollow double diaphragm 600 of conductive material having opposed elongate elliptically-shaped dished walls 600*a*, 600 *b*. The spring is omitted, the contact diaphragm 600 being fixed to the insulated terminal 12 by means of a crimped ring 600*c*. The contact diaphragm 600 is axially compressed, during assembly of the switch, between the fusible pellet 16 and the terminal 12, thereby to be radially expanded so as to contact the casing 10 at the opposite ends of its major axis. When the pellet collapses, the diaphragm 600 expands axially and contracts radially, out of contact with the casing 10, thus breaking the electrical connection between the casing 10 and the terminal 12. The switch is shown in its operated condition in FIG. 4.

Figure 6:
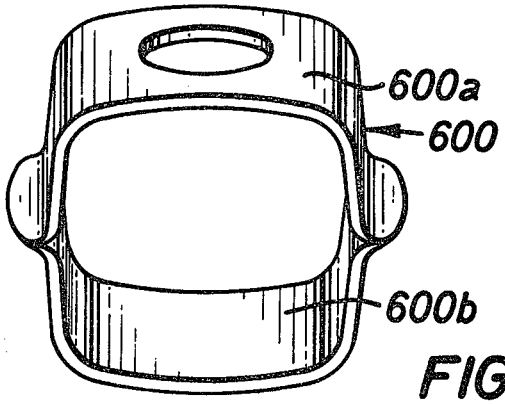
FIG. 6 shows in perspective view a contact mens for the switch of FIG. 3.

The contact diaphragm 600 is also shown in FIG. 6, in its relaxed condition, and the elongate elliptical shape of this diaphragm is apparent from this figure.

In a modification of the construction of FIG. 3, the contact diaphragm 600 is freely located between the terminal 12 and the pellet 16 during assembly of the switch, and a spring analogous to the spring 501 of FIG. 1 is provided to urge the radially contracted contact diaphragm 600 out of contact with the terminal 12, when the pellet collapses.

The fusible pellet 16 comprises a mixture of fusible waxes and a ferrite material. The ferrite material is powdered and mixed with the fusible waxes, in at least 10 parts by volume of ferrite to 100 parts waxes, before pressing the mixture into pellet form.

The particular properties of ferrites which make them useful are not necessarily the same as those properties making them useful for other purposes. While the action of the ferrites is not fully understood, it appears from comparative tests that the ability of ferrites to act as a heat sink is of prime significance. In any case, the effect of inclusion of the ferrite material is to prevent any softening of the pellet at temperatures below the preselected temperature of disintegration. It is found that the pellet remains hard until the preselected temperature is reached, and the pellet then disintegrates abruptly, giving rapid and reliable operation of the switch. The behaviour of the pellet is uniform under differing circumstances. For example, it does not soften below the preselected temperature when the thermal switch is located in conductive fluids, even hot conductive fluids, as may be desired for the protection of oil-filled radiators or the like.

Useful ferrite materials may be produced from iron oxide and one or more other oxides or carbonates. There are many possible useful ferrite materials, but the following ionic formulations are specifically mentioned by way of example:

(1) $MgFe_{1.4}\ Mn_{0.02}\ O_4$
(2) $Ni_1Fe\ Cu_{0.1}\ Fe_{1.9}\ Mn_{0.02}\ O_4$
(3) $NiFe_{1.9}\ Mn_x\ O_4$
(4) $NiFe_{1.9}\ CO_x\ O_4$
(5) $MgFe_{1.4}\ Mn_{0.02}\ O_4$

Various modifications are possible in accordance with the spirit and scope of the invention. In particular, the contact means may take the form of a resilient element of any one of a variety of constructions, such as a U-shaped strip, a single dished diaphragm, a barrel spring, or any other element or member which is capable of radial expansion in response to axial pressure and which automatically relaxes with accompanying radial contraction when the axial pressure is relieved.

I claim:

1. A thermal switch comprising a conductive casing defining a switch axis, a terminal connected to the casing and a terminal entering the casing in insulated relationship thereto, and within the casing a normally solid fusible pellet and a resilient contact means normally in electrically conductive relationship with the insulated terminal, said resilient contact means comprising a hollow structure centered on the switch axis and which is normally subject to compression in the axial direction against said normally solid fusible pellet, to be expanded radially outwards to contact the casing and thereby establish an electrical connection Serial No. 851,196 between the casing and the insulated terminal, said hollow structure also being capable due to its resilience of radial contraction out of contact with the casing when the axial compression is released, the pellet having a preselected temperature of disintegration at which it will collapse to release the axial pressure on the resilient contact means.

2. A switch according to claim 1, wherein the resilient contact means comprises a tubular box of conductive material located between the insulated terminal and the pellet with its axis transverse to the switch axis.

3. A switch according to claim 2, including a spring acting on the contact box to urge said box in the axial direction of the switch when the pellet collapses.

4. A switch according to claim 1, wherein the resilient contact means comprises a double-diaphragm having opposed dished walls.

5. A switch according to claim 4, wherein the contact diaphragm has one of its opposed walls fixed to the insulated terminal.

6. A switch according to claim 4, including a spring acting on the contact diaphragm to urge said diaphragm in the axial direction of the switch when the pellet collapses.

7. A switch according to claim 1, wherein the pellet is made of fusible waxes in admixture with a ferrite material.

8. A switch according to claim 7, including at least 10 parts by volume of ferrite material to 100 parts of fusible waxes.

* * * * *

UNITED STATES PATENT AND TRADEMARK OFFICE

CERTIFICATE OF CORRECTION

PATENT NO. : 4,167,724

DATED : September 11, 1979

INVENTOR(S) : James R. McCaughna

It is certified that error appears in the above—identified patent and that said Letters Patent is hereby corrected as shown below:

Column 5, line 16, delete "Serial No. 851,196".

Signed and Sealed this

*Eleventh* Day of *December 1979*

[SEAL]

*Attest:*

SIDNEY A. DIAMOND

*Attesting Officer*

*Commissioner of Patents and Trademarks*